US005562480A

United States Patent [19]

Drewanz et al.

[11] Patent Number: 5,562,480

[45] Date of Patent: Oct. 8, 1996

[54] ELECTRICAL CONNECTING DEVICE

[75] Inventors: Andreas Drewanz, Mundelein; Robert L. Holmes, Mt. Prospect, both of Ill.; Edward Key, Hummelstown, Pa.; Allan J. Reinken, Skokie, Ill.

[73] Assignee: North American Philips Corporation, New York, N.Y.

[21] Appl. No.: 329,122

[22] Filed: Oct. 25, 1994

Related U.S. Application Data

[62] Division of Ser. No. 919,473, Jul. 24, 1992, Pat. No. 5,364,288.

[51] Int. Cl.[6] ..... H01R 4/24

[52] U.S. Cl. ..... 439/404; 439/417

[58] Field of Search ..... 439/452, 458, 439/459, 460, 468, 402, 403, 404, 399, 400, 709, 712, 713, 721

[56] References Cited

U.S. PATENT DOCUMENTS

| | | | |
|---|---|---|---|
| 3,273,104 | 9/1966 | Krol | 339/128 |
| 3,514,743 | 5/1970 | Schantz | 339/128 |
| 3,596,233 | 7/1971 | De Vito | 339/128 |
| 3,890,029 | 6/1975 | Izraeli | 439/402 |
| 4,053,197 | 10/1977 | Teagno | 339/99 R |
| 4,444,449 | 4/1984 | Aysta et al. | 439/459 |
| 4,632,489 | 12/1986 | Skinner | 439/459 |
| 4,701,138 | 10/1987 | Key | 339/98 |
| 4,975,078 | 12/1990 | Stroede et al. | 439/465 |
| 5,071,365 | 12/1991 | Fremgen et al. | 439/402 |
| 5,071,373 | 12/1991 | Nagasaka et al. | 439/752 |
| 5,073,316 | 12/1991 | Kikuchi et al. | 439/452 |
| 5,088,938 | 2/1992 | Murakami et al. | 439/595 |

FOREIGN PATENT DOCUMENTS

| | | |
|---|---|---|
| 0437782 | 7/1991 | European Pat. Off. . |
| 2089147 | 6/1982 | United Kingdom . |

*Primary Examiner*—David L. Pirlot
*Attorney, Agent, or Firm*—Edward Blocker

[57] ABSTRACT

An electrical connecting device having a receptacle and a two part plug inserted into the receptacle. The two part plug includes an inner part for holding a plurality of zero gap insulation displacement connectors and an outer part for receiving a corresponding plurality of insulated wires. The inner part of the plug can be inserted partially or fully within the outer part of the plug. When the inner plug part is in its partially assembled position, the insulated wires can be easily inserted into the outer part of the plug. When in its fully assembled position, the plurality of connectors within the inner part of the plug are in electrical contact with the insulated wires.

27 Claims, 12 Drawing Sheets

FIG. 4
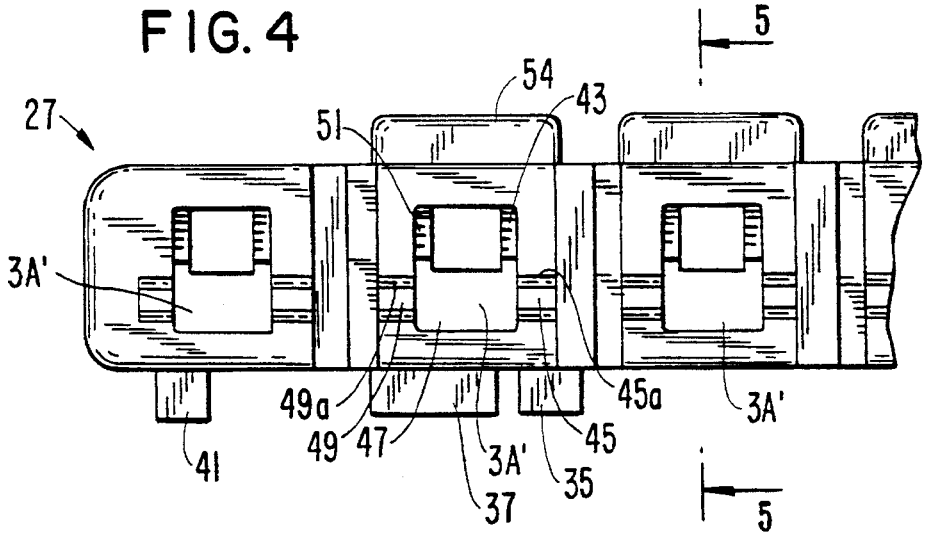
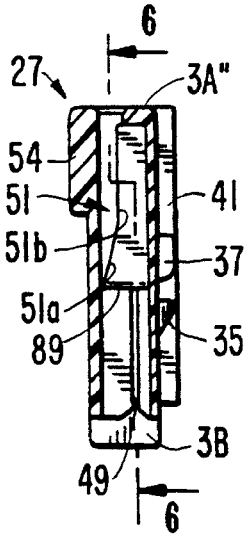
FIG. 5
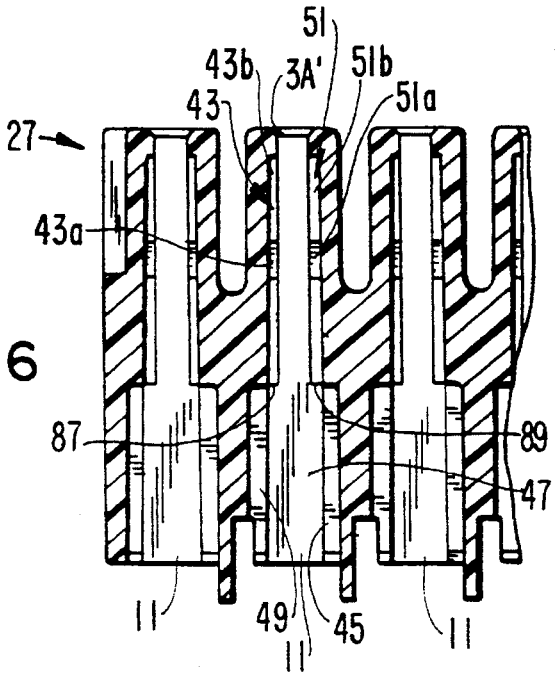
FIG. 6

ELECTRICAL CONNECTING DEVICE

This is a division of application Ser. No. 07/919,473, filed Jul. 24, 1992, now U.S. Pat. No. 5,364,288.

BACKGROUND OF THE INVENTION

The present invention relates to electrical connecting devices, and more particularly to an electrical connecting device for use in factory assembly of lighting equipment as well as field installation for connecting electrical apparatus together.

Electrical connecting devices are commonly used throughout the electrical industry for connecting electrical leads (wires) together. For example, in connecting a lighting fixture (luminaire) to a ballast, lead wires (hard wired to the ballast) are routed directly to the lamp holders located at opposite ends of the fixture. The lamp holders are typically from two to eight feet apart depending on the length of the lamp for which the fixture is designed.

In replacing an inoperative ballast with a new ballast (i.e. ballast retrofit), the wires from the old ballast are cut in order to remove the old ballast. The wires from the old ballast which remain connected to the lampholders are then electrically connected through an electrical connecting device to the replacement ballast. The types of electrical connecting devices commonly available, however, are both time consuming and tedious to use.

Older, less efficient ballasts are not only replaced when they become inoperative. Rather, in view of much higher efficiencies afforded by newer ballasts, older ballasts, which are not yet inoperable, are today routinely replaced by new, more efficient ballasts (of both the electronic and electromagnetic type). A high demand has therefore been created for an electrical connecting device which is less time consuming and easier to use for purposes of ballast retrofit.

Original equipment manufacturers (OEM's) of lighting fixtures are continually seeking new methods to contain luminaire manufacturing costs. One such method employs modular construction with leadless ballasts and separate wiring harnesses resulting in assembly line automation of the lighting fixture. The electrical connecting device therefore should also be adaptable for use with leadless ballasts and the like, that is, for OEM purposes.

Several different ballast retrofit methods are commonly available. In a first conventional ballast retrofit method, referred to as "wire trap" or "poke-home", wire ends are stripped within a suitable tolerance range and then poked into proper terminal cavities of a multiple cavity connector on the ballast. Such poking typically takes place in a darkened area standing on a ladder with the ballast overhead. Under such conditions, stripping of wire ends within a suitable range of tolerances can be quite difficult. Wire ends must be stripped to a prefixed length in employing the wire trap method. For example, when the length of wire stripped is too small, the wire cannot be properly poked into the terminal cavity. When the length of wire stripped is too large, exposed wire outside of the terminal cavity can result in short circuit and/or electrical shock conditions. The wire trap method is also not suitable for OEM purposes. More particularly, the wire trap method does not by itself provide for a separate wiring harness.

In yet another type of conventional ballast connecting method, barrel terminals are crimped to the ends of the wires and then inserted into a plastic enclosure forming a harness plug. The crimping of these barrels is a precision operation requiring precision tooling. The plug is then inserted into the ballast socket containing mating male pins. The force required in pushing the connector plug into or removing the plug from the connector receptacle during ballast retrofit, however, can damage components within the connector.

These conventional connecting devices are not particularly suitable for purposes of ballast retrofit and ballast manufacture. It is therefore desirable to provide a connecting device which can be easily adapted for connecting electrical wires together whether for purposes of ballast retrofit or manufacture. The connecting device need not and should not be limited to use as a ballast connector and should be suitable for connecting wires of different types of devices together.

SUMMARY OF THE INVENTION

Generally speaking, in accordance with the invention, an electrical connecting device includes a housing and at least one wire receiving passageway. Each wire receiving passageway includes a plurality of protrusions for squeezing the received wire within the wire receiving passageway wherein at least one protrusion has a substantially planar surface against which the received wire is squeezed for retention of the latter. The housing includes an outer plug part and an inner plug part forming a two part plug and a receptacle into which the two part plug is inserted.

The electrical connecting device in accordance with the invention is particularly suitable for both OEM and retrofit purposes. The device has a two part plug which includes an inner plug part and an outer plug part. This two part plug serves as a separate wiring harness in which the wires can be easily inserted into and retained by the plug. The two part plug is retained within a receptacle of the connector.

In accordance with another aspect of the invention, both the inner plug part and outer plug part have ribs/walls which interleave with each other so as to increase the creepage path (i.e. the path across the surface of a dielectric between two wires) to minimize the possibility of voltage flashovers between adjacent wires.

In accordance with yet another aspect of the invention, the inner plug part and outer plug part have respectively a substantially flat top and a substantially flat bottom to facilitate applying pressure thereto in inserting the inner plug part within the outer plug part. The inner plug part can assume two positions within the outer plug part (i.e. a partially assembled position and a fully assembled position). In view of this flat top and bottom, the two part plug can be easily assembled by applying pressure to the top and bottom of the inner plug part and outer plug part through use of a pair of pliers or the like, respectively.

In accordance with still another aspect of the invention, guidance rails extending longitudinally along the inner plug part are slidably received by corresponding slits extending longitudinally along the outer plug part. These guidance rails and corresponding slits permit off-center application by pliers or the like of compression forces for inserting the inner plug part within the outer plug part. More particularly, the guidance rails and slits in combination permit off-center moments of force to be absorbed by the inner plug part and outer plug part without cocking of the two part plug relative to each other.

In accordance with a further aspect of the invention, the receptacle of the connector includes a plurality of resilient protrusions extending laterally from the receptacle along a first plane and a flange encircling the receptacle and extending laterally from the receptacle in a second plane parallel to and separated at a predetermined distance from the first plane. The receptacle when inserted through an opening of a housing such as, but not limited to, a ballast can, is secured to the can by fitting the border of the opening between the plurality of protrusions and flange. The flange also serves as a lip to compensate for variance in ballast can thickness and to provide a seal for potting (e.g. tar) within the housing and barrier to outside contaminants.

Accordingly, it is an object of the invention to provide an improved connecting device suitable for OEM and retrofit purposes.

It is another object of the invention to provide an improved ballast connecting device in which wires can be easily connected into and retained by the device without having to strip the ends of the wires.

It is still another object of the invention to provide an improved connecting device having a separate detachable wiring harness.

Still other objects, features and advantages of the invention will, in part, be obvious and will, in part, be apparent from the specification.

The invention accordingly comprises the several steps and the relation of one or more such steps with respect to each of the others, and the apparatus embodying features of construction, combinations of elements and arrangements of parts which are adapted to effect such steps, all as exemplified in the following detailed disclosure, and the scope of the invention will be indicated in the claims.

BRIEF DESCRIPTION OF THE DRAWINGS

FIG. 4 is a fragmented, bottom plan view of an inner plug part of the electrical connecting device;

FIG. 5 is a sectional view taken along lines 5—5 of FIG. 4 a rotated counterclockwise by 90°;

FIG. 6 is a sectional view taken along lines 6—6 of FIG. 5;

DETAILED DESCRIPTION OF THE PREFERRED EMBODIMENTS

Figure 1A:
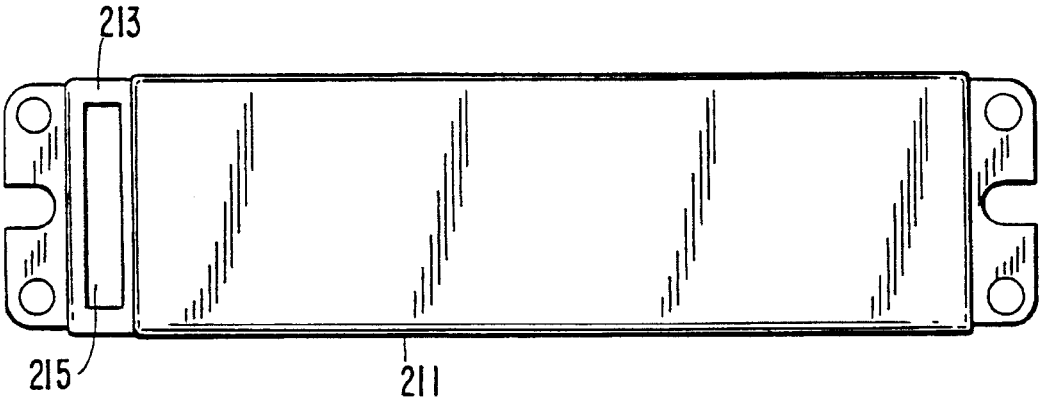
FIGS. 1A and 1B are bottom plan and side elevational views, respectively, of a fluorescent lamp ballast housing.
Figure 1B:
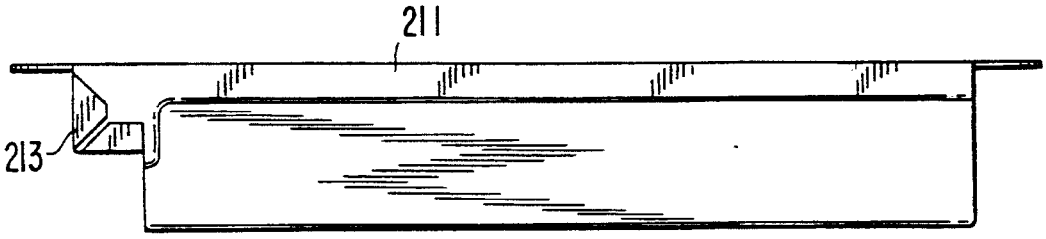

Referring to FIGS. 1A and 1B, a container or can 211 serving as the ballast housing for a gaseous discharge lamp includes a step 213 having an aperture 215. Can 211 is shown in FIGS. 1A and 1B without an electrical connecting device 200 attached thereto, the latter of which will be discussed below. It is to be understood that can 211 in a lighting installation is typically mounted with the step 213 disposed in a downwardly direction. Access to components within the interior of can 211 can be had through aperture 215 of step 213.

Figure 2:
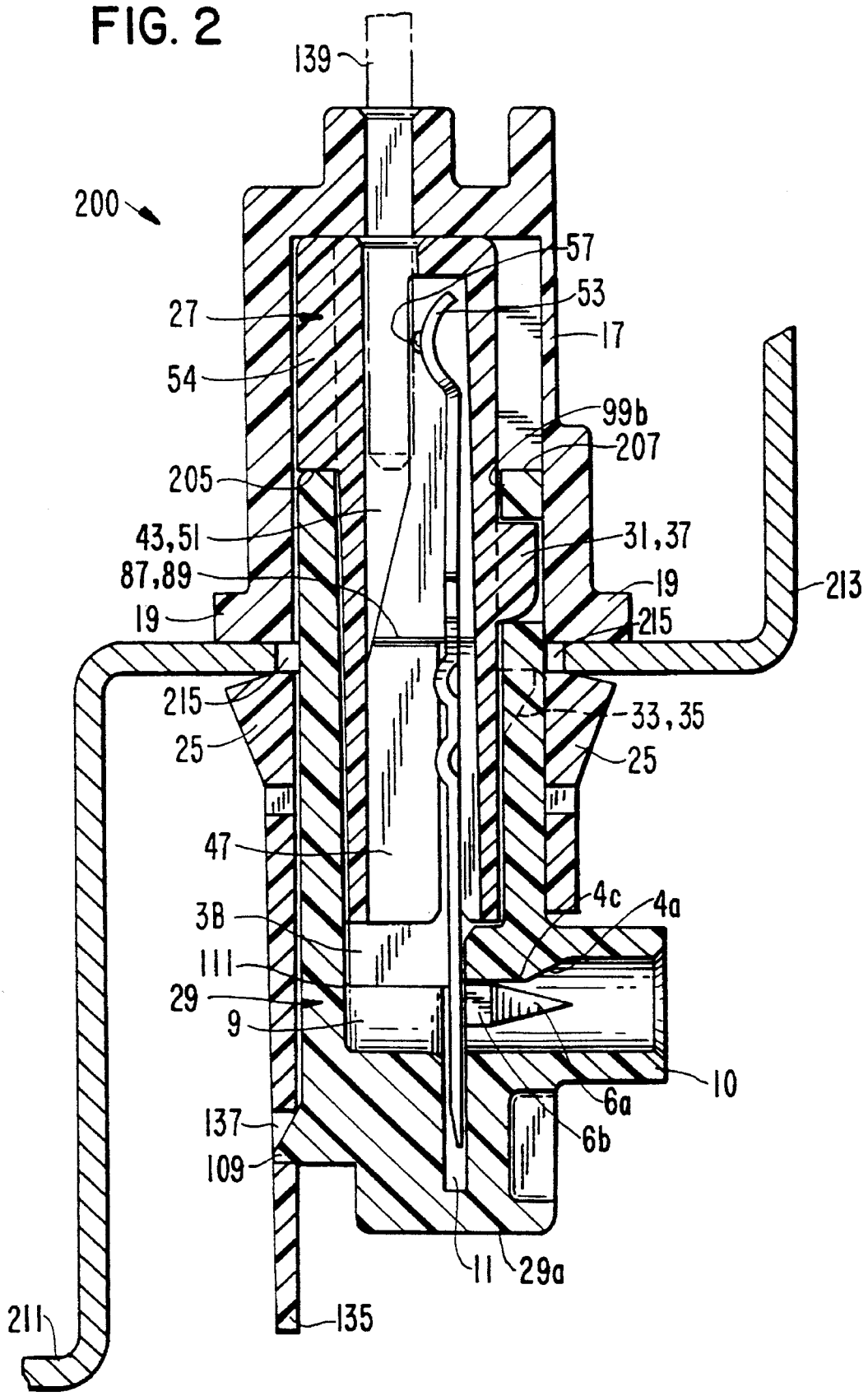
FIG. 2 is a sectional view of an electrical connecting device in accordance with the invention.

As shown in FIG. 2, device 200 in accordance with the invention includes a receptacle 17, an inner plug part 27 and an outer plug part 29. As discussed below inner plug part 27 and outer plug part 29 can be assembled together to form a plug which is inserted into receptacle 17 to form connector 200.

In attaching device 200 to can 211, receptacle 17 is pushed outwardly from within can 211 through aperture 215 during ballast assembly so as to partially protrude outside can 211 (i.e. beyond seep 213). Receptacle 17 includes a flange 19 and four flexible stubs 25 which abut the periphery/border of aperture 215 to position and secure receptacle 17 to and within can 211. In assembling receptacle 17 to can 211, resilient stubs 25 are bent inwardly as they travel by the border of aperture 215 returning toward their original unbent positions as they travel beyond this border. Through the interference fit between stubs 25 and the border of aperture 215, receptacle 17 is securely mounted in can 211.

Figure 3:
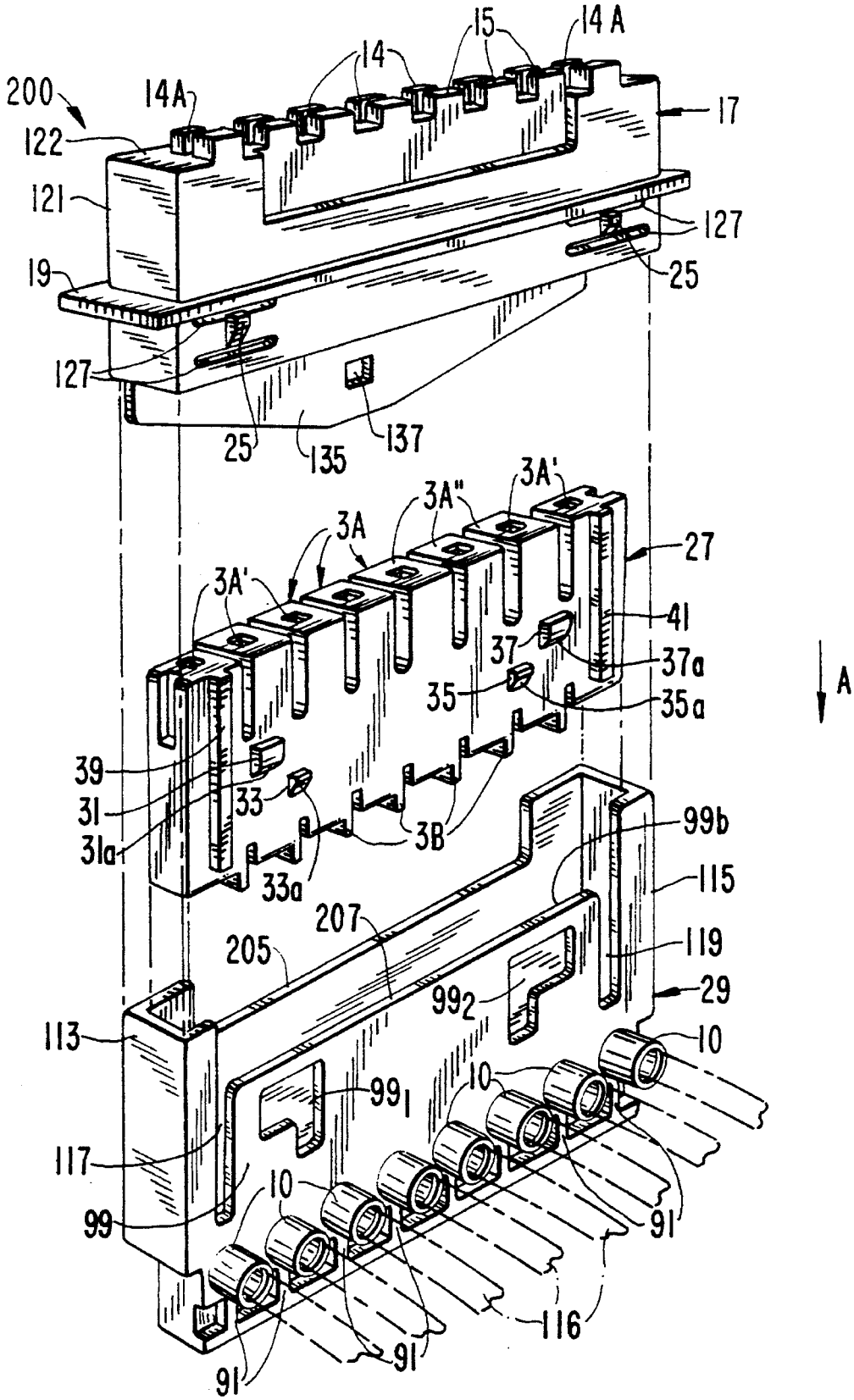
FIG. 3 is an exploded perspective view of an electrical connecting device in accordance with the invention.

As shown in FIG. 3, a pair of flexible stubs 25 are positioned at the front of receptacle 17. Similarly, a pair flexible stubs 25 are positioned at the rear of receptacle 17.

Figure 15:
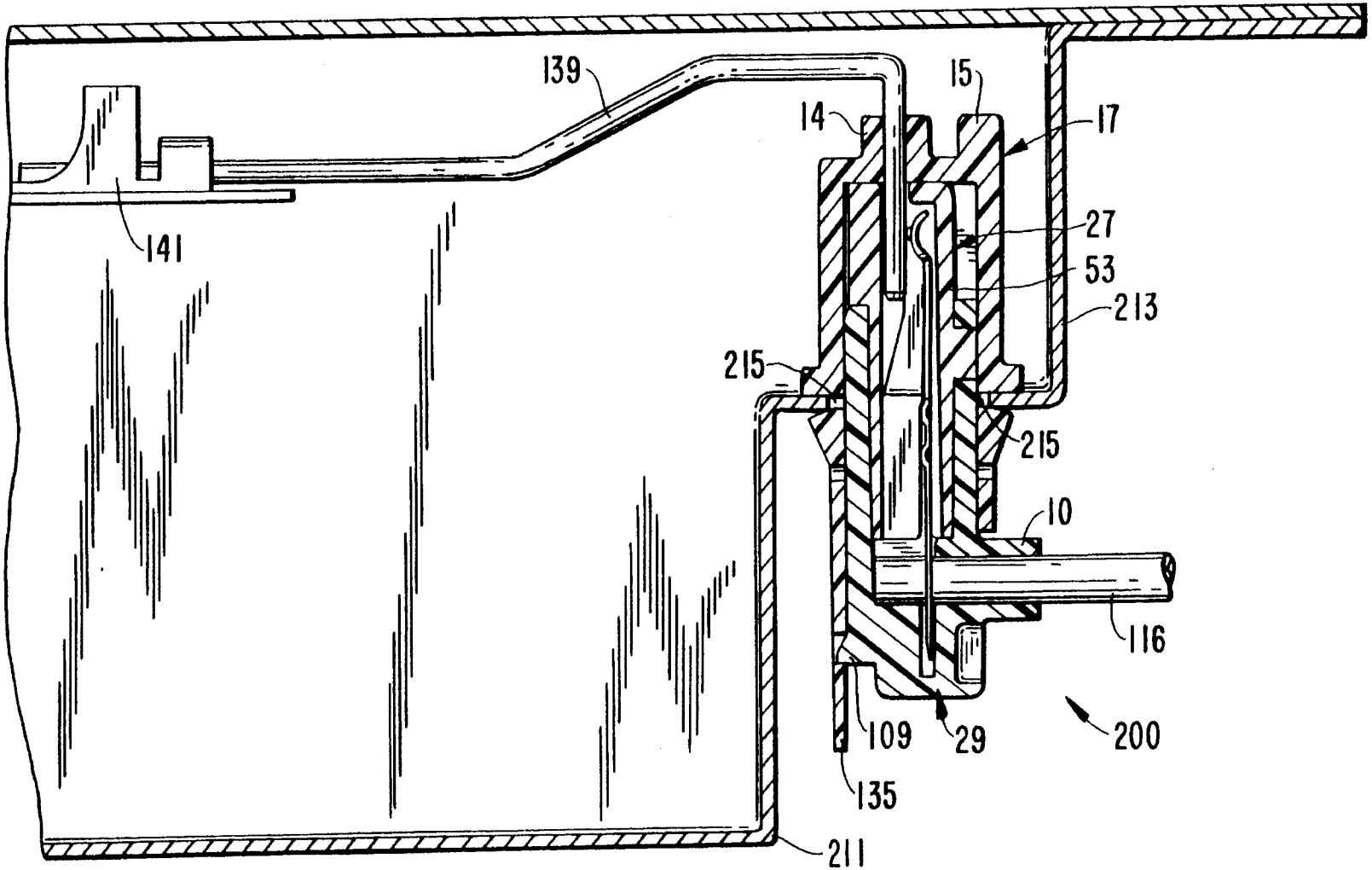
FIG. 15 is a fragmentary sectional view of the electrical connecting device assembled to an electromagnetic ballast housing.

Inner plug part 27 as shown in FIGS. 3–6 has a plurality of compartments 3A. Molded on one side of inner plug part 27 are a plurality of detents 31, 33, 35 and 37 and a pair of guide rails 39 and 41 for connecting inner plug part 27 to outer plug part 29. Each of these compartments includes an opening 3A' through which a pin 139 extends (see FIGS. 2 and 15) for connection between device 200 and the electrical circuitry within can 211. A plurality of interlocking ribs 3B for extending creep distance (i.e. the path across the surface of a dielectric between two wires) between wires (further discussed below) are provided at the bottom of inner plug part 27.

As shown in FIGS. 4–6, inner plug part 27 also includes a projection 54. Projection 54 extends from the top of compartment 3A and serves as a stop for properly positioning inner plug part 27 within outer plug part 29. More particularly, as inner plug part 27 is seated within outer plug part 29, projection 54 comes into contact and rests upon a ledge 205 of outer plug part 29. Each of compartments 3A has a channel 47 with a pair of slots (trenches) 45 and 49 on opposing sides of channel 47. Each channel 47 also includes a pair of guide members 43 and 51 on opposing interior sides of channel 47 for guiding an insulation displacement contact (IDC) 53 as further discussed below.

As shown in FIG. 5, each guide member 43 (51) has a ramp 43*a* (51*a*) and a flat (plateau) 43*b* (51*b*). As shown in FIG. 6, proximate to ramps 51*a* and 43*a* are a pair of stops 87 and 89, respectively. To facilitate description of compartment 3A, FIGS. 4–6 are shown without IDC 53 disposed within compartment 3A.

Figure 7A:
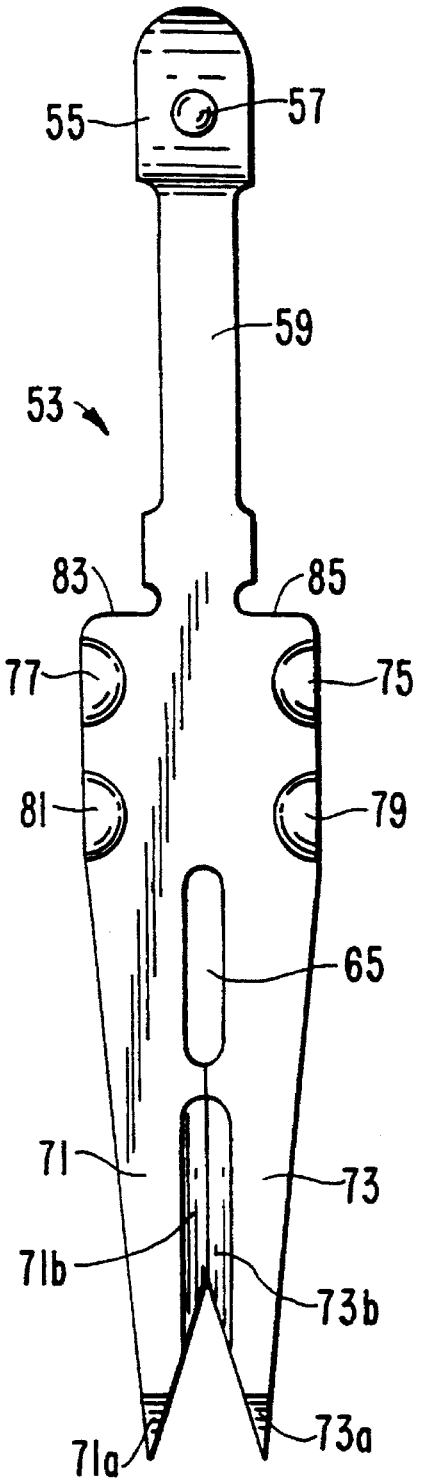
FIGS. 7A and 7B are front and side elevational views of an insulation displacement contact in accordance with one embodiment of the invention.
Figure 7B:
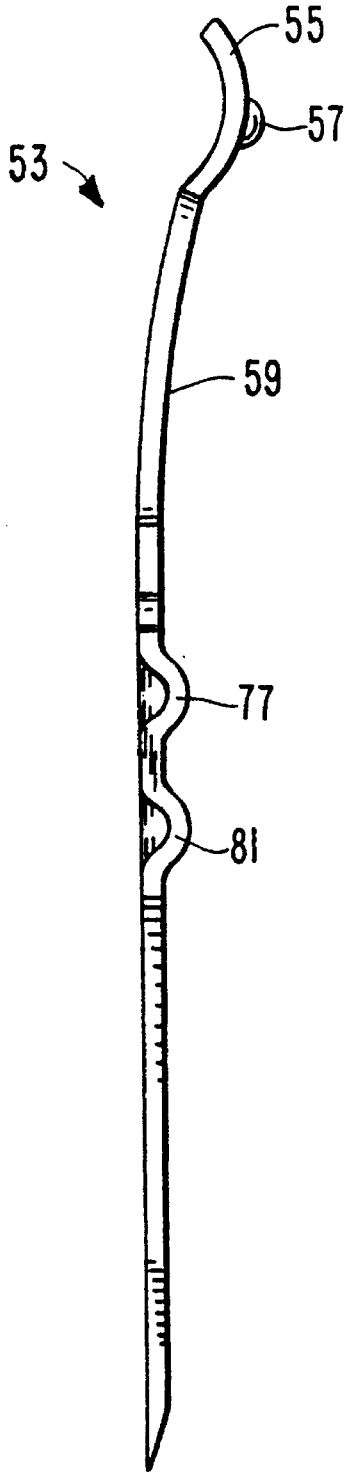

As shown in FIGS. 7A and 7B, IDC 53 includes a pair of blades 71 and 73 having a zero gap therebetween and a stress relief opening 65. Each compartment 3A has an IDC 53 disposed within. IDC 53 also includes a pair of shoulders 83 and 85 and a paddle-shaped end 55 having a contact button 57, edges 55*a* and a concave cross section. A resiliently bent arm 59 connects blades 71 and 73 to paddle-shaped end 55 and biases contact button 57 toward and for contact with a pin 139 (see FIG. 2).

The distal ends of blades 71 and 73 are coined (chambered) and form a pair of tines 71*a* and 73*a*, respectively. A pair of interior edges 71*b* and 73*b* of blades 71 and 73 are also coined, respectively. Tines 71*a* and 73*a* and edges 71*b* and 73*b* are coined (i.e. metal reduced in thickness) to more easily pierce the insulation of an insulated wire. Edges 71*b* and 73*b* are in contact with each other (i.e.: zero gap therebetween).

More particularly, as shown in FIGS. 12A, 12B, 13A and 13B, blades 71 and 73 are operable for piercingly receiving an insulated electrical wire 116. As wire 116 is forced against blades 71 and 73, blades 71 and 73 separate from each other (i.e., from their zero gap position). As IDC 53 is pushed down against wire 116, tines 71*a* and 73*a* pierce an insulation 119 of wire 116. Blades 71 and 73 spread apart as edges 71*b* and 73*b* cut insulation 119 of wire 116 providing electrical contact i.e. biting engagement between an electrical conductor 117 of wire 116 and blades 71 and 73. Blades 71 and 73 each have a pair of dimples 75, 79 and 77, 81, respectively, for properly positioning of IDC 53 within inner plug part 27.

Variations in tine configurations 71*a* and 73*a*, interior edges 71*b* and 73*b*, slot size and/or stress relief opening 65, dimensional spread of tip points of tines 71*a* and 73*a* and configuration of the "V" shaped wire lead in between edges 71*b* and 73*b*, all are inter-related to produce variable reactions when inserting wire 116. These variable reactions affect the force necessary to pierce or cut through insulation 119 and force necessary to insert wire 116 to the fully installed position of conductor 117 between blades 71 and 73. The variable reactions will also affect the amount of deformation of conductor 117 by blades 71 and 73 which will also affect the amount of axial force required to pull out conductor 117 from between blades 71 and 73.

Figure 7C:
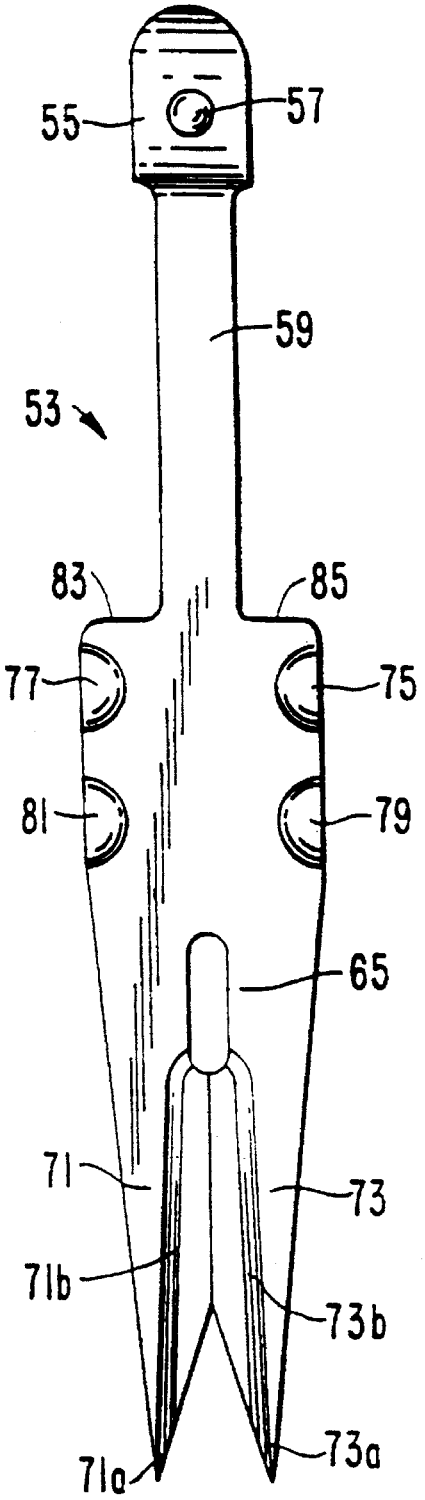
FIGS. 7C and 7D are front and side elevational views of an insulation displacement contact in accordance with an alternative embodiment of the invention.
Figure 7D:
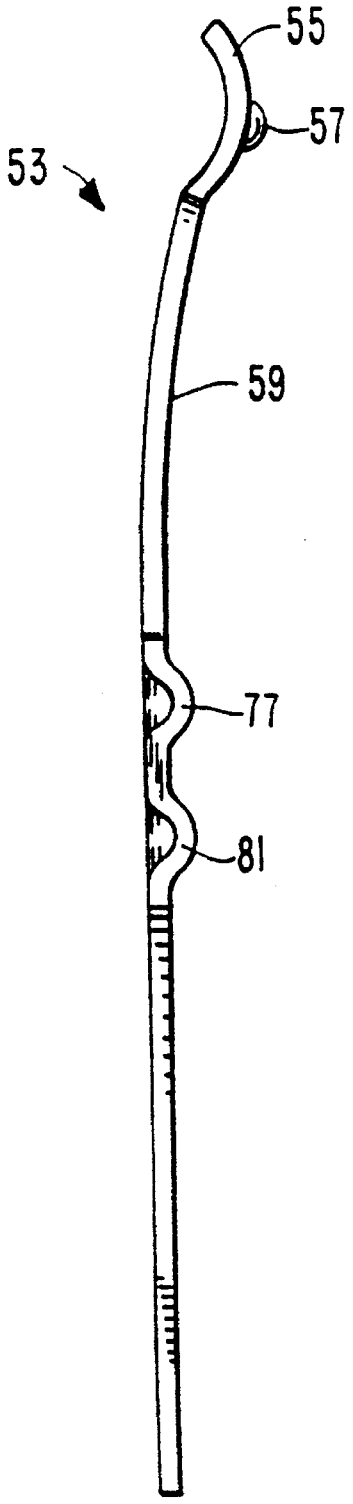

Wire 116 when inserted into the configuration shown in FIGS. 7C and 7D will require less insertion force and yield more conductor deformation than wire 116 when inserted into the configuration shown in FIGS. 7A and 7B. The interplay of configurations and reactions should therefore be tailored to insulations and conductors of specific materials to optimize reactions for specific applications.

FIGS. 7C and 7D show IDC 53 with a "V" style coin of edges 71*b* and 73*b*, 0.070 spread of tines 71*a* and 73*a* and 0.075 stress relief opening 65. Tines 71*a* and 73*a* have coin common to edges 71*b* and 73*b* to form a continuous knife like edge from tines 71*a* and 73*a* through edges 71*b* and 73*b*, respectively (where fully inserted wire 116 resides).

As shown in FIG. 2, each IDC 53 is disposed within a compartment 3A of inner plug part 27 by first inserting paddle-shaped end 55 of IDC 53 into the bottom of a corresponding channel 47. As IDC 53 is slid into channel 47, edges 55*a* of paddle-shaped end 55 slide along and against guide members 43 and 51 thereby straightening connector arm 59 from its bent unloaded position until shoulders 83 and 85 reach stops 87 and 89. Members 43 and 51 therefor bias paddle-shaped end 55 towards pin 139. Dimples 75, 77, 79 and 81 of each IDC 53 provide an interference fit for the latter. More particularly, during insertion of IDC 53 within a corresponding compartment 3A, dimples 75, 79 and 77, 81 slide and come to rest against the interior walls of slots 45 and 49, respectively. Dimples 75, 77, 79 and 81 therefore serve as retention bumps for retaining IDC 53 within a slot 11. Each compartment 3A has a corresponding IDC 53 inserted therein. The compartments 3A provide electrical isolation of IDCs 53 from each other. Following insertion of IDCs 53 into inner plug part 27, inner plug part 27 is inserted into outer plug part 29.

Figure 11A:
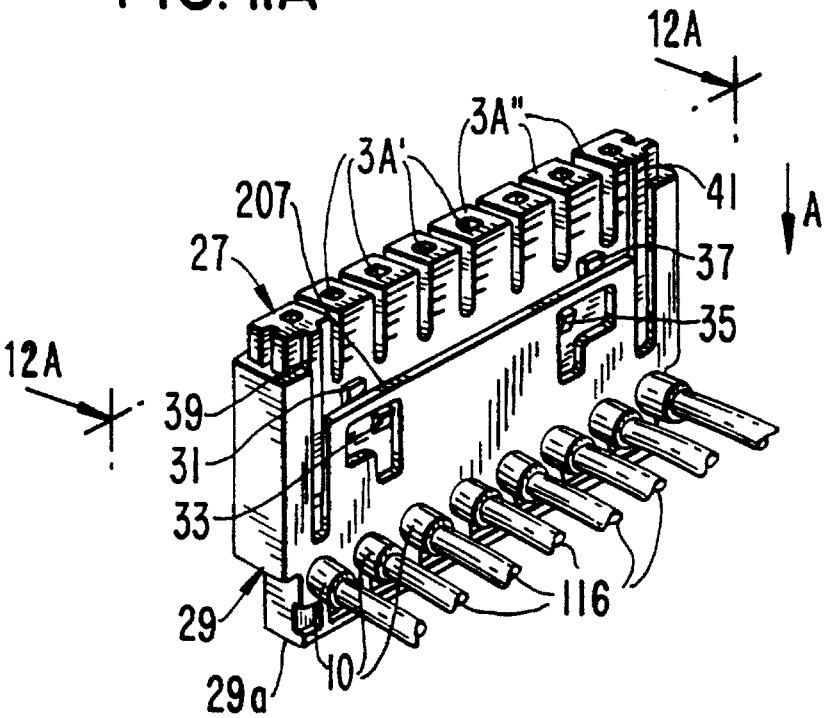
FIG. 11A is a perspective view of the inner plug part partially assembled within the outer plug part.

Inner plug pare 27 can be partially or fully inserted within outer plug part 29. In its partially assembled position, inner plug part 27 is partially inserted into outer plug part 29 by pushing/sliding inner plug part 27 in a direction of an arrow A, as shown in FIGS. 2, 3 and 11A into outer plug part 29. Inner plug part 27 is inserted into outer plug part 29 so that detents 33 and 35 protrude from apertures $\mathbf{99}_1$ and $\mathbf{99}_2$, respectively. In this partially assembled position, detents 31 and 37 are positioned above a ledge 207 of front wall 99 of outer plug part 29. Detents 31, 35, 37 and 39 have beveled surfaces 31*a*, 33*a*, 35*a* and 37*a*, respectively to facilitate sliding against an interior wall 99*b* (see FIG. 3) as inner plug part 27 is inserted into outer plug part 29. With detents 33 and 35 protruding from apertures 33 and 35 and detents 31 and 37 above ledge 207, inner plug part 27 is secured to outer plug part 29 and is typically shipped in this partially assembled position. As will be discussed in greater detail below, when in this partially assembled position wires 116 are inserted in protrusions 10 of outer plug port 29.

order to complete assembly (fully assembled position) of inner plug part 27 within outer plug part 29, inner plug part 27 is pushed/slid further into outer plug part 29 in the direction of arrow A so that detents 31, 33 and 35, 37 protrude from apertures $\mathbf{99}_1$ and $\mathbf{99}_2$, respectively. The partially assembled and fully assembled positions of inner plug part 27 within outer plug part 29 will be further discussed below.

FIG. 3 illustrates, for exemplary purposes only, inner plug part 27 in its fully assembled position without insertion of wire(s) 116 into one or more of a plurality of tubular protrusions 10 extending from a front wall (wire receiving side) 99. It is to be understood, however, that all wires 116 should be inserted into outer plug part 29 prior to inner plug part 27 being pushed into its fully assembled position.

Figure 8:
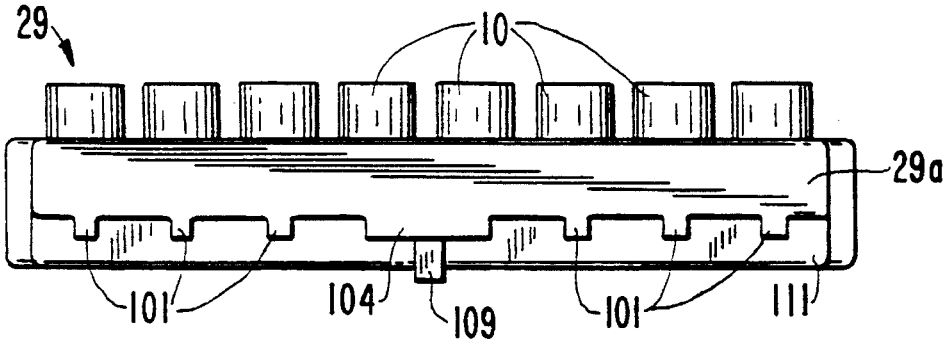
FIG. 8 is a bottom plan view of an outer plug part of the electrical connecting device.

Each of protrusions 10, shown in FIG. 3, corresponds to one of the plurality of compartment 3A of inner plug part 27. Tubular protrusions 10 are supported at their bottom by a plurality of ribs 91 formed at the bottom of front wall 99. As shown in FIGS. 3 and 8, a plurality of reinforcing ribs 91 and 101 support a bottom surface 29*a* of outer plug part 9. A rib 104 supports both bottom surface 29*a* and a locking tab 109. Locking tab 109, which is integrally connected to a flat back wall 111 of outer plug part 29, is operable for locking outer plug part 29 to receptacle 17 as will be further discussed below.

End walls 113 and 115, shown in FIG. 3, at the top of outer plug part 29 serve as guides for facilitating insertion of inner plug part 27 into outer plug part 29. A pair of slits 117 and 119 increase the flexibility of wall 99 and are operable for receiving guide rails 39 and 41 of inner plug part 27 to properly seat and position inner plug part 27 within outer plug part 29. Guidance rails 39 and 41 in combination with slits 117 and 119, respectively, permit off-center moments of force to be absorbed by inner plug part 27 and outer plug part 29 without cocking of the two part plugs relative to each other.

Figure 9A:
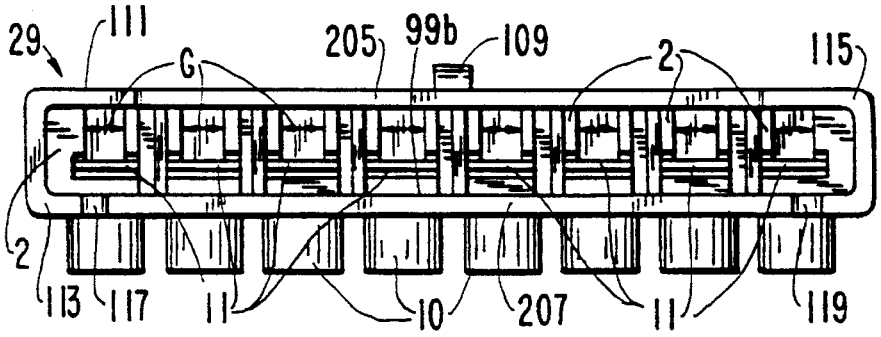
FIGS. 9A and 9B are a top plan view and a front elevational view of the outer plug part, respectively.
Figure 9B:
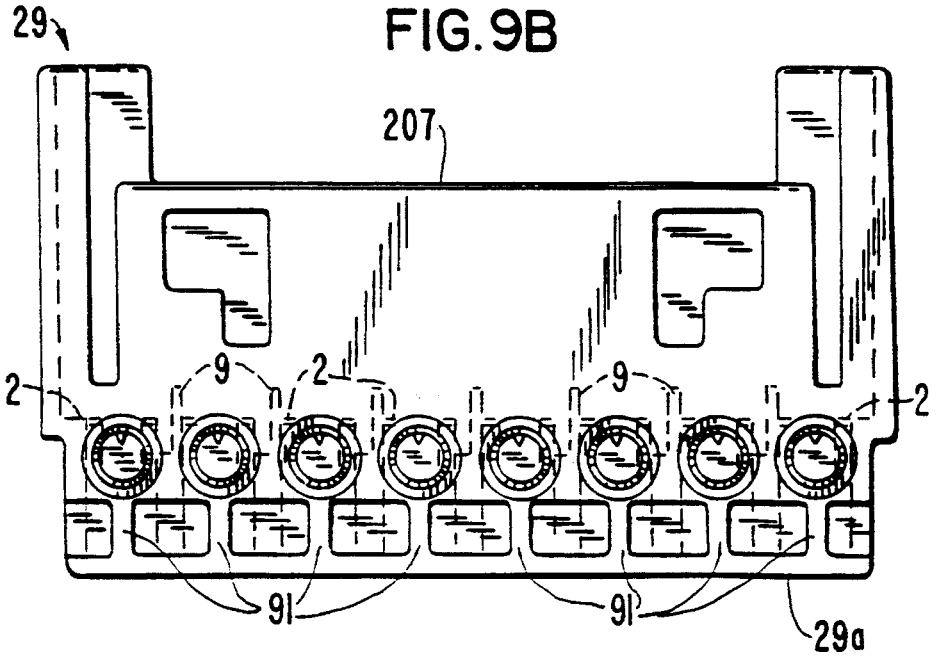

As shown in FIGS. 9A and 9B, a plurality of J-shaped elements 9 are positioned adjacent to and extend beyond the rear of tubular protrusions 10. Tubular protrusions 10 extend partially within the interior of outer plug part 27. A pair of walls 2, associated with each tubular protrusion 10, extend inwardly toward protrusion 10 from back wall 111. Each pair of walls 2 is separated by a gap G dimensioned to receive the outer diameter of distal end 116*a* (FIGS. 13A, 13B) of wire 116. When inner plug part 27 is in its fully assembled position within outer plug part 29, interlocking ribs 3B of inner plug part 27 overlap elements 9 of outer plug part 29 so as to substantially electrically isolate each of compartments 3A from each other at and around the point of entry of wires 116 within outer plug 29. More particularly, elements 9 and interlocking ribs 3B provide a convoluted path for increasing the creep path (distance) between adjacent wires 116 so as to reduce the possibility of voltage flashovers between wires 116 in adjacent compartments 3A.

Figure 10A:
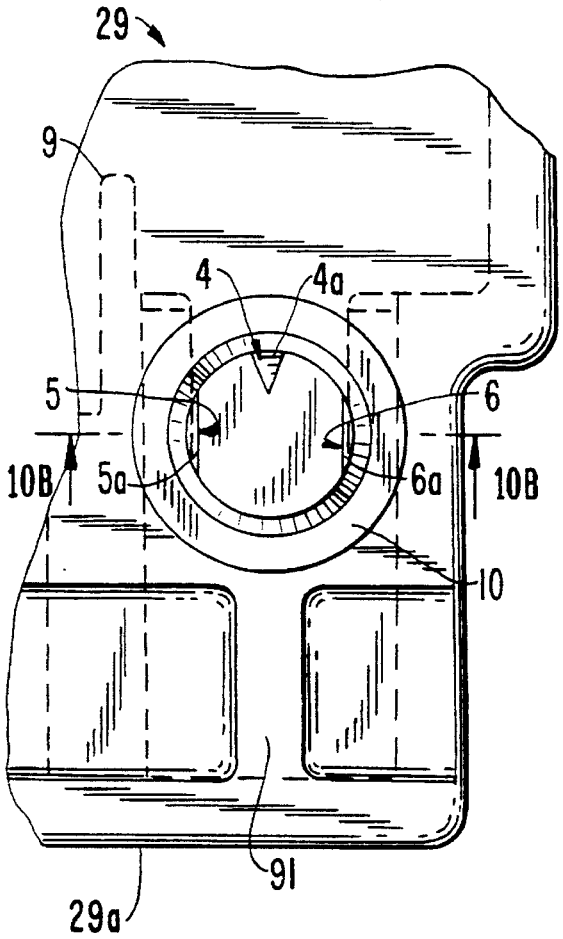
FIG. 10A is a fragmented, front elevational view of the outer plug part.
Figure 10B:
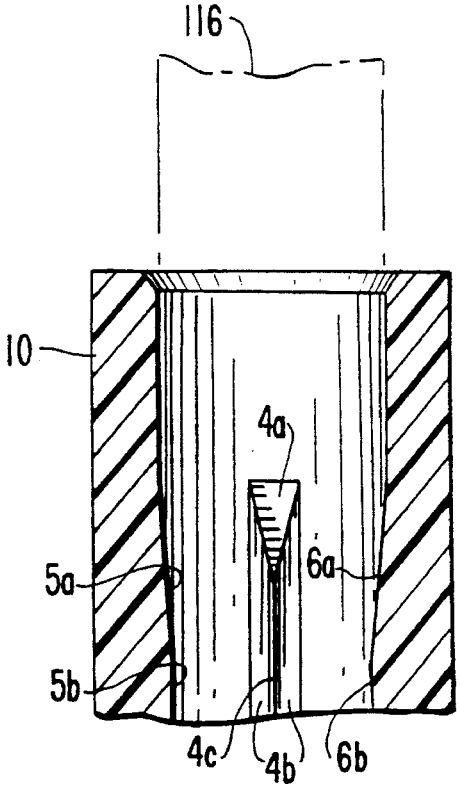
FIG. 10B is a fragmented cross-sectional view of an outer plug part tubular protrusion; taken along lines 10B—10B of FIG. 10A.

Referring now to FIGS. 2, 10A and 10B, each tubular protrusion 10 includes three inwardly facing projections 4, 5 and 6. Projections 5 and 6 within each tubular protrusion 10 are positioned diametrically opposite each other. Projection is circumferentially centered between projections 5 and 6. Projections 5 and 6 have substantially flat rectangular ramps 5*a* and 6*a* and flats (plateaus) 5*b* and 6*b*, respectively. Projection 4 has a flat triangular ramp 4*a* leading to a knife edge (fish hook) 4*c* with a pair of sloped sides 4*b*.

As a wire 116 is pushed into tubular protrusion 10, projections 4, 5 and 6 squeeze and thereby serve to retain wire 116 within tubular protrusion 10 with projections 5 and 6 also serving to center wire 116 laterally within tubular protrusion 10. Knife edge 4*b* serves to form a groove in insulation 119 of wire 116 so as to restrict torque-like movement of wire 116 within tubular protrusion 10. Ramps 4*a*, 5*a* and 6*a* permit wire 116 to be inserted relatively easily between projections 4, 5 and 6. Flats 5*b* and 6*b* and edge 4*b* terminate abruptly (i.e. at approximate right angles) as shown in FIG. 2. That portion of wire insulation 119 travelling beyond the abrupt endings of protrusions 4, 5 and 6 swells at least partially back to its original outer diameter through recovering elastic movement of insulation 119. Such swelling further aids in retention of wire 116 within tubular protrusion 10. In one preferred embodiment, the inner diameter of tubular protrusion 10 tapers from a diameter of 0.095 inches to 0.085 inches culminating in flat 5*b* or 6*b* of length 0.025 inches. That is, ramps 5*a* and 6*a* rise an an angle of about 3.58°. Ramp 4*a* rises to a height of 0.023 inches within a distance of 0.046 inches (26.57° taper). Knife edge 4*c* typically forms a groove of about 0.011 inches in insulation 119 when wire 116 is 18 AWG.

Figure 13A:
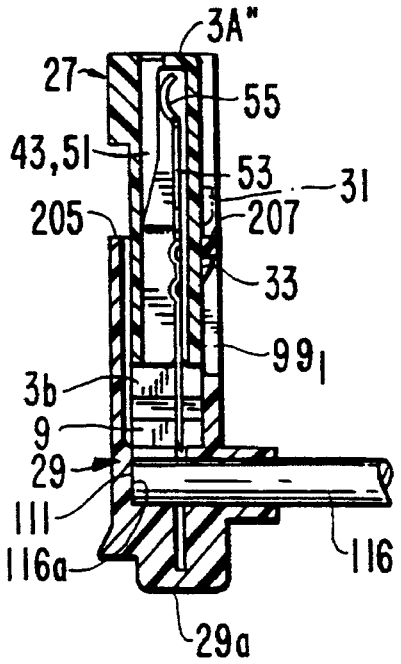
FIG. 13A is a sectional view taken along lines 13A—13A of FIG. 12A.
Figure 13B:
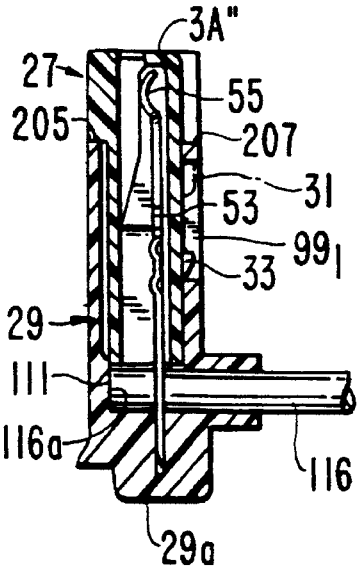
FIG. 13B is a sectional view taken along lines 13B—13B of FIG. 12B.

As wire 116 is pushed into compartment 3*a*, that is, beyond protrusions 4, 5 and 6, wire 116 is no longer squeezed by projections 4, 5 and 6 and at least partially resumes (swells back) its original outer diameter. As shown in FIGS. 13A and 13B, with wire 116 fully inserted into outer plug part 29, distal end 116*a* of wire 116 is pushed against back wall 111 of outer plug part 29. A wire receiving passageway along which wire 116 travels within connector 200 is formed, in part, by tubular protrusion 10 and continues until reaching back wall 111.

As shown in FIG. 9A, associated with each tubular protrusion 10 is slot 11 formed from the associated back of tubular protrusion 10, the front of each pair of walls 2 and a portion of element 9. Each slot 11 is operable for receiving IDC 53. Slot 11, as shown in FIG. 2, extends near the bottom of outer plug part 29 for receiving tines 71*a* and 73*a*.

A portion of each tubular protrusion 10 also serves as a strain relief device. More particularly, for reducing the strain placed on wire 116 by engagement with IDC 53 and projections 4, 5, and 6, each projection 10 extends beyond projections 4, 5, and 6 so as to intercept wire 116 prior to projections 4, 5, and 6 contacting wire 116.

Figure 11B:
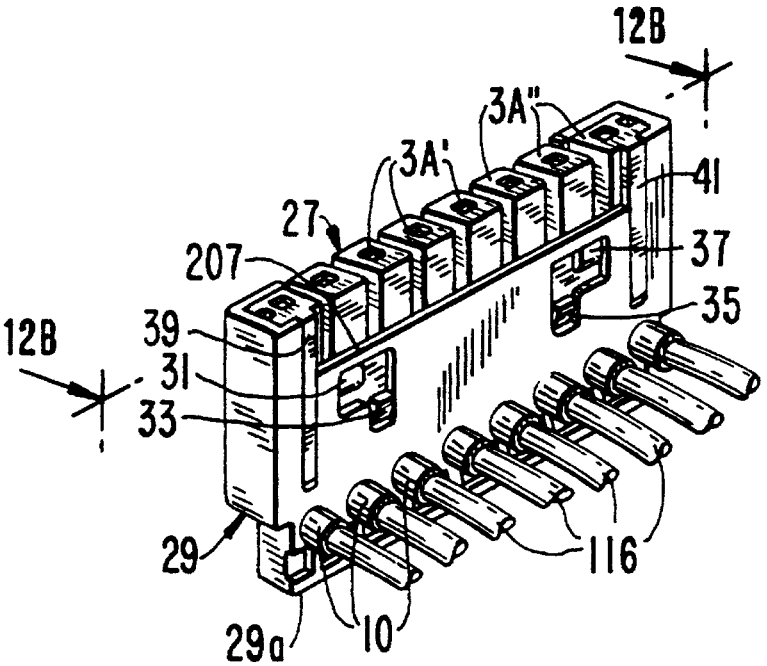
FIG. 11B is a perspective view of the inner plug part fully assembled within the outer plug part.
Figure 12A:
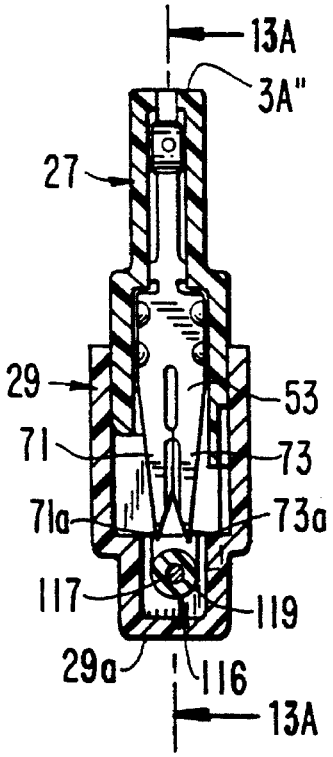
FIG. 12A is a sectional view taken along lines 12A—12A of FIG. 11A.
Figure 12B:
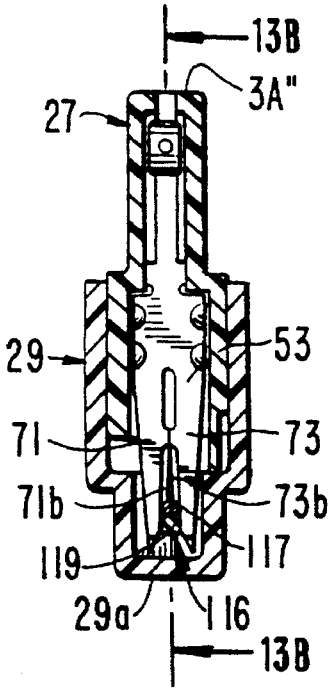
FIG. 12B is a sectional view taken along lines 12B—12B of FIG. 11B.

FIGS. 11A, 12A and 13A illustrate inner plug part 27 in its partially assembled position within outer plug part 29 with distal ends 116*a* of wires 116 pushed into and against back wall 111 of outer plug part 29. FIGS. 11B, 12B and 13B illustrate inner plug part 27 in its fully assembled position within outer plug part 29. Each compartment 3A has a substantially flat top 3A" and outer plug part 29 has a substantially flat bottom 29*a* to facilitate employing a pair of pliers or the like for applying suitable pressure in forcing inner plug part 27 into its fully assembled position within outer plug part 29. As inner plug part 27 is pushed from its partially assembled position to its fully assembled position within outer plug part 29, tines 71*a* and 73*a* pierce insulation 119 with edges 71*b* and 73*b* cutting insulation 119 and making electrical contact i.e. biting engagement with conductor 117 of wire 116. As shown in FIG. 12B, as electrical contact is made between edges 71*b* and 73*b* and conductor 117, the zero gap between edges 71*b* and 73*b* is no longer maintained. Rather, edges 71*b* and 73*b* become separated from each other.

As can be readily appreciated from FIGS. 11A, 12A and 13A, wires 116 (e.g. from a lighting fixture) are easily inserted into tubular protrusions 10 of outer plug part 29 with inner plug part 27 in its partially assembled position within outer plug part 29. Retrofit of a new ballast can therefore be performed in a more convenient location near but not inside a darkened luminaire. Each of wires 116 is held against movement by protrusions 4, 5 and 6. Upon insertion of wire 116 into its respective tubular protrusion 10 such that distal end 116*a* of each wire 116 is pushed against back wall 111 of outer plug part 29, inner plug part 27 and outer plug part 29 can be pushed together by applying pressure to tops 3A" of inner plug part 27 and to bottom 29*a* of outer plug part 29. This pressure can be easily applied by use of a suitable pair of pliers or the like.

Figure 14:
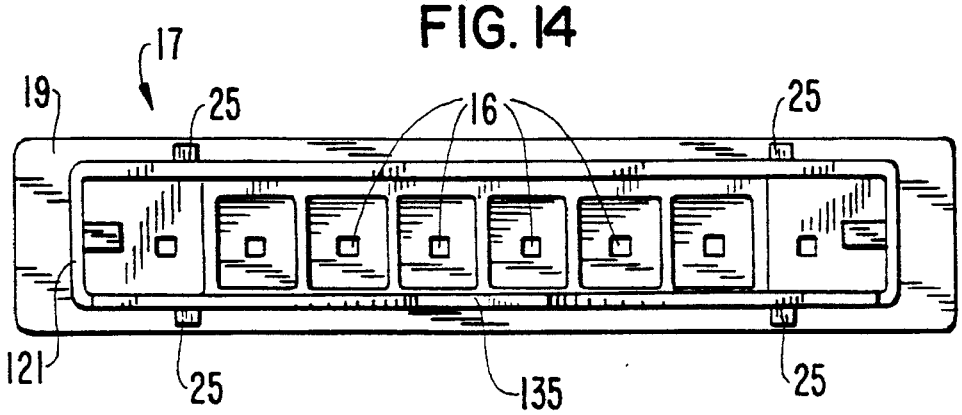
FIG. 14 is a bottom plan view of the connector receptacle.

As shown in FIGS. 3 and 14, receptacle 17 receives the two part plug formed by inner plug part 27 and outer plug part 29. Receptacle 17 includes a four wall container 121 having a top 122 with a row of stabilizing tabs 15 and a row of stacks 14 including end stacks 14A. Stabilizing tabs 15 are operable for stabilizing receptacle 17 when mounted, for example, on a printed circuit board within can 11. Stacks 14A are larger than intermediate stacks 14 to accommodate corresponding compartments 3A of inner plug part 27 and ends 113 and 115 of outer plug part 29.

Figure 16:
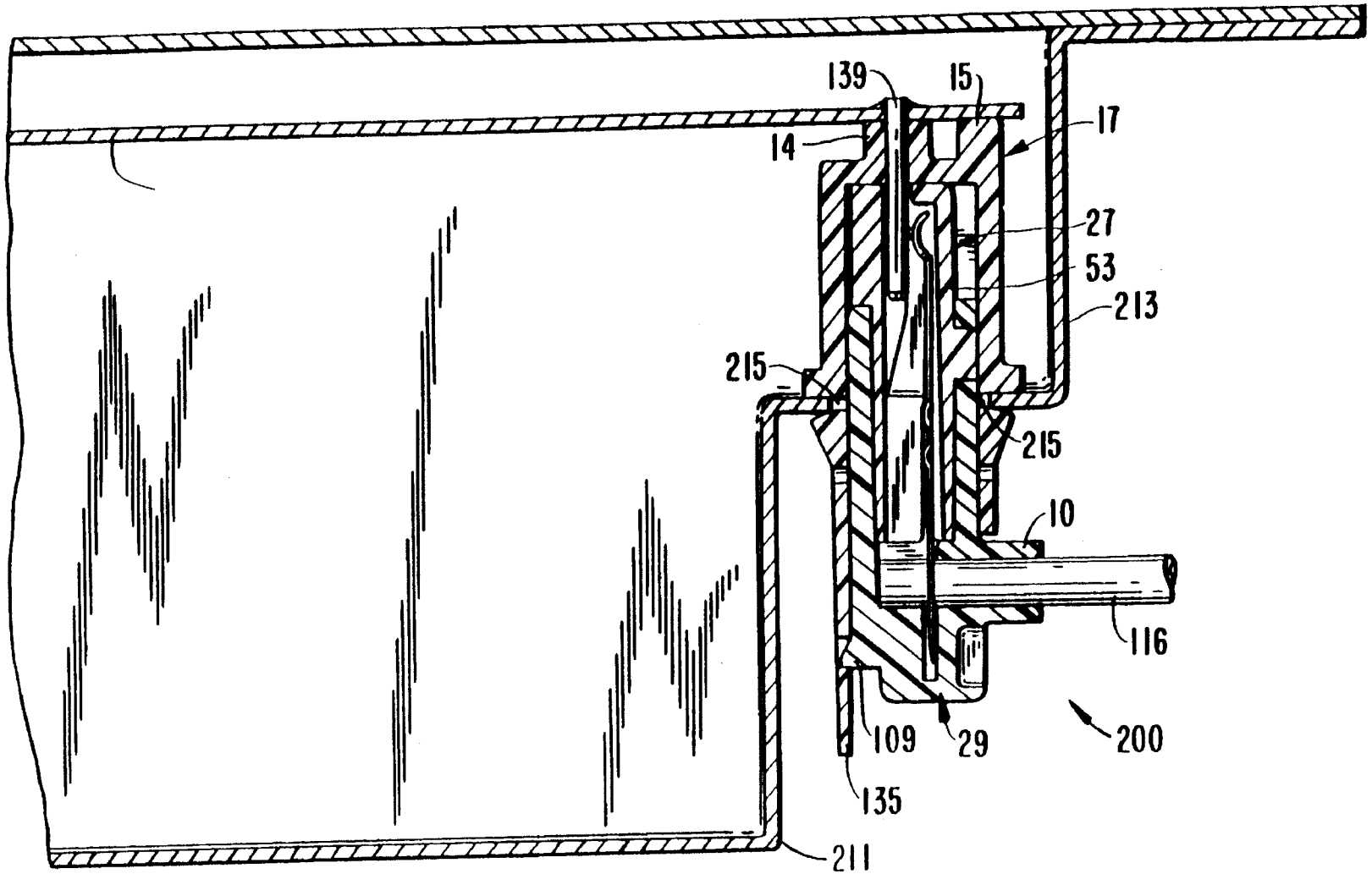
FIG. 16 is a fragmentary sectional view of the electrical connecting device assembled to an electronic or hybrid electromagnetic ballast housing.

Each of stacks 14, 14A has an aperture 16 to permit the introduction of connector pin 139 into and through stack 14, 14A. Connector pins 139 are connected to terminals such as a terminal 141 within ballast can 211 of the electromagnetic type (see FIG. 15) or are inserted directly into a printed wiring board of an electronic or hybrid electromagnetic ballast (see FIG. 16). Inner plug part 27 and outer plug part 29 once joined together are plugged into receptacle 17 with one or more pins 139 already inserted into and extending through corresponding stacks 14, 14A. Channels 47 of inner plug part 27 are aligned with apertures 16 of receptacle 17. Consequently, when the two part plug (i.e. inner plug part 27 and outer plug part 29) is inserted into receptacle 17, contact button 57 of IDC 53 contacts the distal (i.e. lead-in feature) end of pin 139 such that edges 55 of IDC 53 are lifted off ramps 43 and 51. In other words, IDC 53 is now in spring loaded electrical contact with pin 139.

Stubs 25 cooperate with flange 19 to retain receptacle 17 about the periphery of aperture 215 of ballast can 211. A pair of slots 127 above and bellow each stub 25 enhance the flexibility of the latter. Flange 19 wich is uninterrupted and completely encircles serves to form a seal (lip) about the periphery of aperture 215 to prevent leakage of encapsulant contained within can 211.

As shown in FIGS. 2, 3 and 14, receptacle 17 also V includes a back wall 135 extending downwardly to form a resilient flap-like element. Back wall 135 has an aperture 137 formed therein. Resilient back wall 135 with aperture 137 and tab (latch) 109 of outer plug part 29 serve as a detachable lock to secure the two part plug (i.e. inner plug part 27 in its fully assembled position within outer plug part 29) to receptacle 17.

Suitable materials for inner plug part 27, outer plug part 29 and receptacle 17 include, but are not limited to, 33% glass-filled type 66 polyamide or other acceptable thermoplastic/thermoset resins. Connector pin 139 can be, but is not limited to, a square plated copper alloy rod. IDC 53 is preferably made of a pre-plated copper alloy.

It will thus be seen that the objects set forth above and those made apparent from the preceding description, are efficiently attained and, since certain changes may be made in the above method and construction set forth above without departing from the spirit and scope of the invention, it is intended that all matter contained in the above description and shown in the accompanying drawings shall be interpreted as illustrative and not in a limited sense.

It is also to be understood that the following claims are intended to cover all the generic and specific features of the invention herein described, and all statements of the scope of the invention which, as a matter of language, might be said to fall therebetween.

What is claimed is:

1. An electrical connecting device, comprising:

a housing; and at least one receiving means having a longitudinal axis for receiving a wire inserted axially, each receiving means including a plurality of fixed radially-protruding means for squeezing and thereby retaining the received wire within said receiving means.

2. The device of claim 1, wherein each receiving means includes aperture means for insertion of the wire to be received therein, said protruding means extending into said aperture means.

3. The device of claim 1, wherein said housing includes an interior, said aperture means being in spatial communication with said housing interior.

4. The device of claim 1, wherein at least one protruding means includes a substantially knife-like edge for squeezing and restricting torque-like movement of the received wire within said receiving means.

5. The device of claim 1, wherein at least one receiving means is tubular.

6. The device of claim 1, wherein each receiving means has substantially circular aperture means with at least two of said protruding means extending into said aperture means and positioned diametrically opposite one another.

7. The device of claim 1, wherein said housing includes an interior, said receiving means terminating prior to entering said housing interior.

8. The device of claim 1, wherein each receiving means further includes strain relief means for reducing the strain placed on the received wire by said protruding means.

9. The device of claim 1, wherein at least two of the protruding means are operable for centering the received wire within the receiving means.

10. The device of claim 9, wherein each of the protruding means for centering the received wire includes said substantially planar surface.

11. The device of claim 1, wherein at least one protruding means includes a substantially planar surface against which the received wire is squeezed and ramp means for guiding the received wire to the planar surface.

12. The device of claim 11, wherein at least one protruding means includes a substantially knife-like edge for squeezing and restricting torque-like movement of the received wire within said receiving means.

13. The device of claim 11, wherein at least two of the protruding means are operable for centering the received wire within the receiving means.

14. The device of claim 12, wherein each receiving means has substantially circular aperture means with at least two of said protruding means extending into said aperture means and positioned diametrically opposite one another.

15. The device of claim 12, wherein each receiving means further includes strain relief means for reducing the strain placed on the received wire by said protruding means.

16. The device of claim 1, wherein each receiving means further includes strain relief means for reducing the strain placed on the received wire by said protruding means.

17. The device of claim 16, wherein each strain relief means includes tubular means, said tubular means extending in the same direction and beyond said protruding means so as to intercept said received wire prior to said received wire being squeezed by said protruding means.

18. An electrical connecting device, comprising:

a housing; and at least one receiving means for axially receiving a wire, each receiving means including a plurality of fixed protruding means for engaging the wire when inserted and for squeezing it and thereby retaining the received wire within the receiving means;

wherein each protruding means terminates at a substantially right angle to the axial direction in which the wire is received within the receiving means to permit that portion of the received wire travelling beyond the protruding means to at least partially resume its original shape prior to being squeezed thereby enhancing retention of the wire within the receiving means.

19. The device of claim 18, wherein at least one protruding means includes a substantially planar surface against which the received wire is squeezed and ramp means for guiding the received wire to the planar surface.

20. The device of claim 18, wherein at least one protruding means includes a substantially knife-like edge for squeezing and restricting torque-like movement of the received wire within said receiving means.

21. An electrical connecting device, comprising:

a housing; and at least one receiving means for receiving a wire, each receiving means including a plurality of protruding means for squeezing and thereby retaining the received wire within said receiving means, each receiving means further including strain relief means for reducing the strain placed on the received wire by said protruding means, each strain relief means including tubular means, said tubular means extending in the same direction as and beyond said protruding means so as to intercept said received wire prior to said received wire being squeezed by said protruding means.

22. An electrical connecting device, comprising:

a housing; and at least one receiving means for receiving a wire, each receiving means including a plurality of protruding means for squeezing and thereby retaining the received wire within said receiving means, at least one protruding means including a substantially planar surface against which the received wire is squeezed and ramp means for guiding the received wire to the planar surface, at least one protruding means including a substantially knife-like edge for squeezing and restricting torque-like movement of the received wire within said receiving means, two of the protruding means having said substantially planar surfaces being operable for centering the received wire within the receiving means.

23. The device of claim 22, wherein each receiving means has substantially circular aperture means with two of said protruding means having substantially planar surfaces extending into said aperture means and positioned diametrically opposite one another.

24. An electrical connecting device, comprising:

a housing having a plurality of adjacent parallel tubular members each having a longitudinal axis for receiving an insulated wire inserted axially into the tubular member from a front end, each said tubular member having a plurality of fixed protruding means extending radially inward from an inner wall of the tubular member, the protruding means being sized and being located inside the tubular member spaced from its front end such that the wire engages the protruding means only after being inserted a certain axial distance into the tubular member, the protruding means functioning after the wire has been fully inserted to engage and squeeze the insulation on the wire and thus retain the inserted wire within the tubular member.

25. The connecting device of claim 24, wherein the protruding means having a tapered side, tapering inwardly viewed from the front end, to assist the insertion of the wire and squeezing of its insulation.

26. An electrical connecting device, comprising:

a housing; and at least one receiving means for receiving a wire inserted axially into the receiving means, each receiving means including a plurality of fixed radially-inwardly-extending protruding means for squeezing and thereby retaining the received wire within said receiving means, at least one protruding means including a substantially planar surface against which the received wire is squeezed and ramp means for guiding the received wire to the planar surface, said ramp means being sized to engage the wire when inserted into the receiving means.

27. The device of claim 26, wherein at least one protruding means includes an axially-extending substantially knife-like edge for squeezing and restricting torque-like movement of the received wire within said receiving means.

* * * * *